US005477683A

United States Patent [19]

Persson

[11] Patent Number: 5,477,683

[45] Date of Patent: Dec. 26, 1995

[54] METHOD AND DEVICE DURING STARTING AND LOW-LOAD OPERATION OF A ONCE-THROUGH BOILER

[75] Inventor: Rune Persson, Finspong, Sweden

[73] Assignee: ABB Carbon AB, Finspong, Sweden

[21] Appl. No.: 993,617

[22] Filed: Dec. 21, 1992

[30] Foreign Application Priority Data

Dec. 20, 1991 [SE] Sweden ..... 9103797

[51] Int. Cl.[6] ..... F22D 7/00

[52] U.S. Cl. ..... 60/653; 60/646; 60/679

[58] Field of Search ..... 60/646, 653, 652, 60/679; 122/406.4, 406.5

[56] References Cited

U.S. PATENT DOCUMENTS

| | | | |
|---|---|---|---|
| 3,035,557 | 5/1962 | Litwinoff | 60/653 |
| 3,264,826 | 8/1966 | Kane et al. | 60/679 |
| 4,430,962 | 2/1984 | Miszak | 60/652 |
| 4,487,167 | 12/1984 | Haller et al. | 123/406.4 |
| 5,044,163 | 9/1991 | Brückner et al. | 60/653 |
| 5,048,466 | 9/1991 | Ruud | 60/646 |

*Primary Examiner*—Stephen F. Husar
*Assistant Examiner*—L. Heyman
*Attorney, Agent, or Firm*—Pollock, Vande Sande & Priddy

[57] ABSTRACT

A method for use during starting and/or low-load operation of a once-through boiler. The method includes the steps of generating steam in a steam generator; separating water from the steam in a moisture separator; heating the steam in a superheater and feeding the steam to a high-pressure turbine; returning expanded steam from the high-pressure turbine to a reheater for heating before supplying the steam to an intermediate-pressure turbine; supplying the separated water from the moisture separator to a reheater flashbox; and feeding stream separated in the reheater flashbox to the reheater.

14 Claims, 9 Drawing Sheets

METHOD AND DEVICE DURING STARTING AND LOW-LOAD OPERATION OF A ONCE-THROUGH BOILER

FIELD OF THE INVENTION

The present invention relates to a method and a device for maximizing the steam production in the superheater and the reheater for the purpose of obtaining the necessary cooling of these components in connection with starting and/or low-load operation of a once-through boiler, for example a PFBC once-through boiler.

BACKGROUND OF THE INVENTION

In the steam system of a PFBC power plant an optimum dimensioning of feedwater preheaters, economizers, evaporators and reheaters entails special problems under certain operating conditions, for example at low or very low load. A PFBC power plant also comprises a gas cycle, in which combustion gases from the combustor of the plant drive a gas turbine. Upon, for example, start-up of the plant or upon a gas turbine trip or upon an emergency stop of the combustor in the plant, the steam flow through the superheater and/or the reheater may become insufficient. As a result, too high a temperature is attained in the boiler tubes of the steam heater and/or reheater. Consequently, these boiler tubes may become damaged, because the superheater and reheater tubes do not receive sufficient cooling under the above-mentioned operating conditions.

During the bed heating phase and when changing to coal firing upon start-up of a PFBC power plant, as well as in case of a gas turbine or a steam turbine trip in the plant, the cooling of the surfaces of the superheater and reheater tubes must be ensured. The necessary steam flow through these tubes for cooling of the tube surfaces must be maintained. This is particularly necessary for the tube bundle of the reheater since, in a PFBC boiler where the tube bundles of the superheater and the reheater in the vertical direction are uniformly distributed in the bed, these tube bundles are heated simultaneously and to the same extent. Contrary to a conventional boiler, in the PFBC boiler a constant temperature of the superheated steam can be maintained from full load approximately down to Benson load, without having to take measures, such as injection of abnormal quantities of water, flue gas recirculation or similar known methods. This is an advantage from the point of view of efficiency and transients and is achieved in a PFBC boiler by the selection of a suitable tube bundle geometry for the reheater. However, this also means that the lowest tube surfaces of the superheater and reheater tube bundles are disposed at approximately the same level in the bed. Upon start-up of the boiler, these tube bundles will thus be heated simultaneously, that is, they both need steam for cooling at the same time. With conventional steam system solutions and especially upon cold-start of the plant, the steam flow reaches the tube bundle of the reheater late and is not of sufficient magnitude. This is due to the fact that steam disappears through open valves, part of the steam is condensed upon heating of cold surfaces in the live steam and reheater conduits between the boiler and the steam turbine and, finally, part of the steam is used to build up the pressure in the volumes of these conduits.

It would be desirable to give priority to the steam production in both the superheater and the reheater from start up to operation at Benson load and that these heating surfaces are ensured cooling also in the event of a steam turbine trip or a sudden load reduction without the boiler having to be stopped.

SUMMARY OF THE INVENTION

The present invention relates to a method and a device during starting or low-load operation of a once-through boiler, for example a PFBC boiler, for maximizing the steam production in the superheater and the reheater. This is achieved by conducting water, which has been separated from live steam in a moisture separator, to a flashbox from where steam produced under pressure reduction when flowing out to the flashbox is fed to the reheater. In this way, the reheater is supplied with steam at an early stage during start-up and the steam flow to the reheater is maintained during low-load operation.

The water, separated in the moisture separator, can also, in an alternative embodiment of the invention, be repumped into the feedwater circuit while feedwater is discharged to the flashbox to ensure the cooling of economizers in the feedwater circuit upstream of the feedwater preheater, while at the same time steam separated in the flashbox is fed to the reheater.

By means of the method described, a possibility is obtained of improving the temperature characteristics of the reheater and of reducing the starting time. This can be done by establishing, during start-up, cooling steam flows at an early stage both to the superheater and to the reheater. In addition, a possibility of controlling the steam flow distribution between the superheater and the reheater is obtained.

BRIEF DESCRIPTION OF THE DRAWINGS

FIG. 2 illustrates the flows during combustor heating and bed heating, FIG. 3 shows the flows during operation of the boiler below the Benson point, and FIG. 4 describes the flows above the Benson point.

FIG. 6 illustrates the flows during combustor heating, whereas FIG. 7 shows the flows during bed heating. FIG. 8 shows the flows during operation of the boiler below the Benson point, and FIG. 9 describes the flows above the Benson point.

DESCRIPTION OF THE PREFERRED EMBODIMENTS

A few embodiments of the invention will be described with reference to the accompanying drawings. Different flow paths for steam and water in-the steam system are described and shown under different operating conditions of the plant, and at the same time it is shown how the reheater during start-up and low-load operation of the plant is supplied with steam from a reheater flashbox RFB arranged in the steam system.

Figure 1:
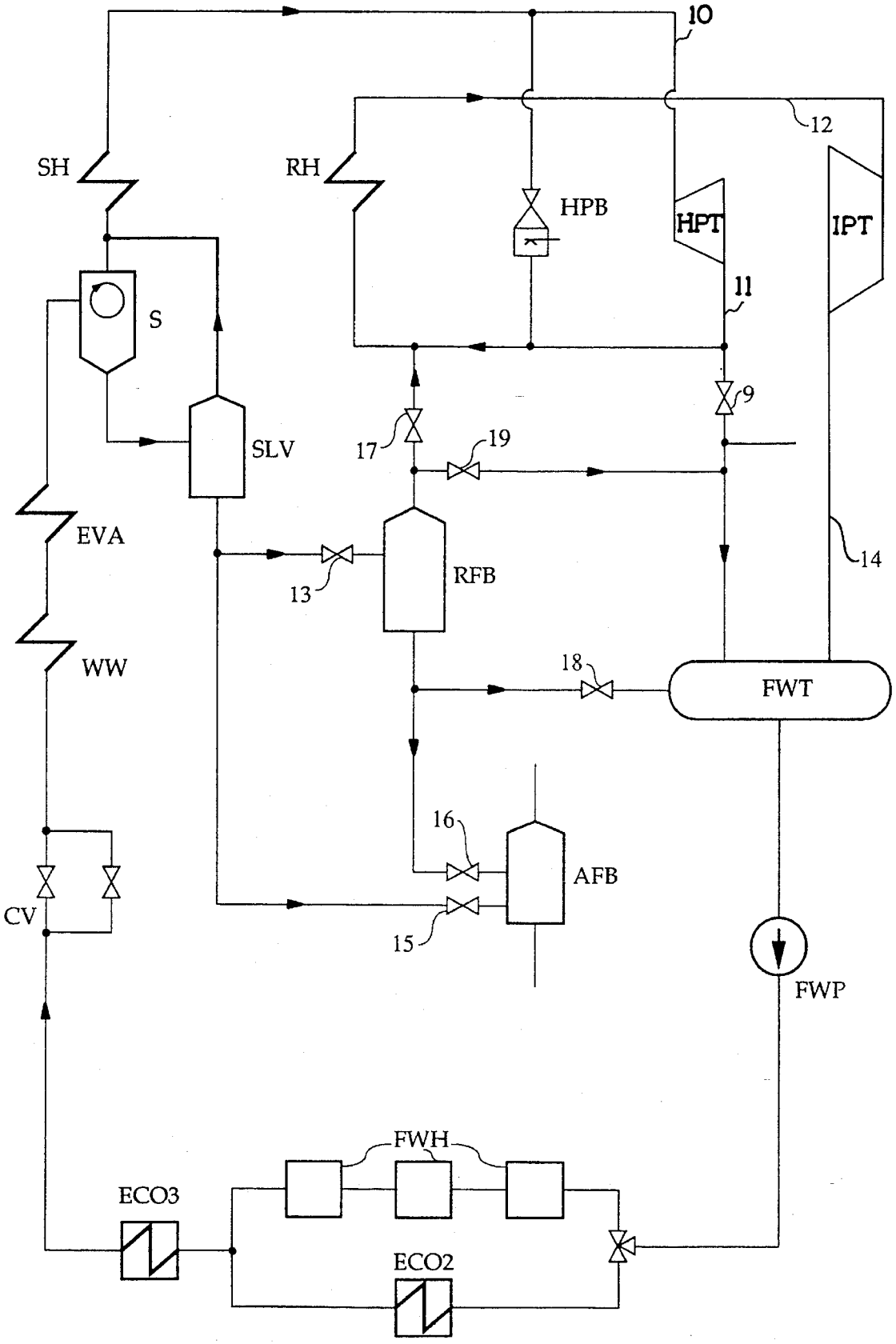
FIG. 1 schematically shows the steam system in a power plant according to the invention.

FIG. 1 schematically shows the steam system in a PFBC power plant. From a feedwater tank FWT, degasified feedwater is pumped to an economizer ECO2 for heating of the feedwater. Alternatively, the degasified feedwater is pumped to the economizer ECO2 and to high-pressure feedwater preheaters FWH, arranged in parallel with the economizer ECO2, comprising one or more preheaters arranged in series. The feedwater is forwarded to an additional economizer ECO3 and thereafter via feedwater control valves CV to a feedwater preheater which consists of tube panels in the combustor walls WW. From the combustor walls the feedwater is passed on to an evaporator EVA, which consists of steam tubes in the fluidized bed of the PFBC plant. In the evaporator EVA, live steam is generated which in a two-phase flow flows out into a moisture separator S. The moisture separator S is equipped with an associated level vessel SLV, which controls the level of water separated from the live steam in the moisture separator S.

The steam liberated from water in the moisture separator S is thereafter supplied to one or more superheaters SH, which also consist of steam tubes in the bed of the PFBC boiler. From the superheater SH the steam is carried off via the conduit 10 to a high-pressure turbine (not shown). The steam expanded in the high-pressure turbine is returned via the conduit 11 to the reheater RH, which also consists of steam tubes in the bed of the PFBC boiler. Between conduit 10 and conduit 11, in parallel with the high-pressure turbine, there is arranged a high-pressure bypass valve HPB. In the reheater RH, the steam is heated again while at the same time cooling the bed, whereupon the steam is now supplied to an intermediate-pressure and a low-pressure turbine (not shown) via the conduit 12. After expansion in intermediate-pressure and low pressure turbines and subsequent condensing, the water is returned to the feedwater tank FWT via a conduit 14.

A valve 9 delivers auxiliary steam to the feedwater tank FWT during start-up and low-load operation, when the ordinary steam extraction is not sufficient.

If the condensate from the level vessel SLV cannot be used for reintroduction into the steam cycle, it is passed on via the valve 15 to an atmospheric flashbox AFB, or via the valve 13 through the reheater flashbox RFB via the valve 16 to the atmospheric flashbox AFB.

Upon start-up of a PFBC power plant, the process is initiated by heating the combustor with air from a compressor. The feedwater tank FWT is filled with degasified feedwater. The boiler is filled with water to start level in the level vessel SLV and is not pressurized. The feedwater pump FWP supplies the economizers ECO2, ECO3, the combustor walls WW and the evaporator EVA with a minimum water flow, which reaches the moisture separator S. The flow is controlled by means of the feedwater control valves CV. Via the economizers the feedwater is supplied with energy. Two-phase flow arises after the feedwater control valves CV, and this two-phase flow flows through the combustor walls WW and the evaporator EVA. The generated water-containing steam is separated from the water in the moisture separator S and continues to the superheaters SH for heating and pressurization of the steam system.

Figure 2:
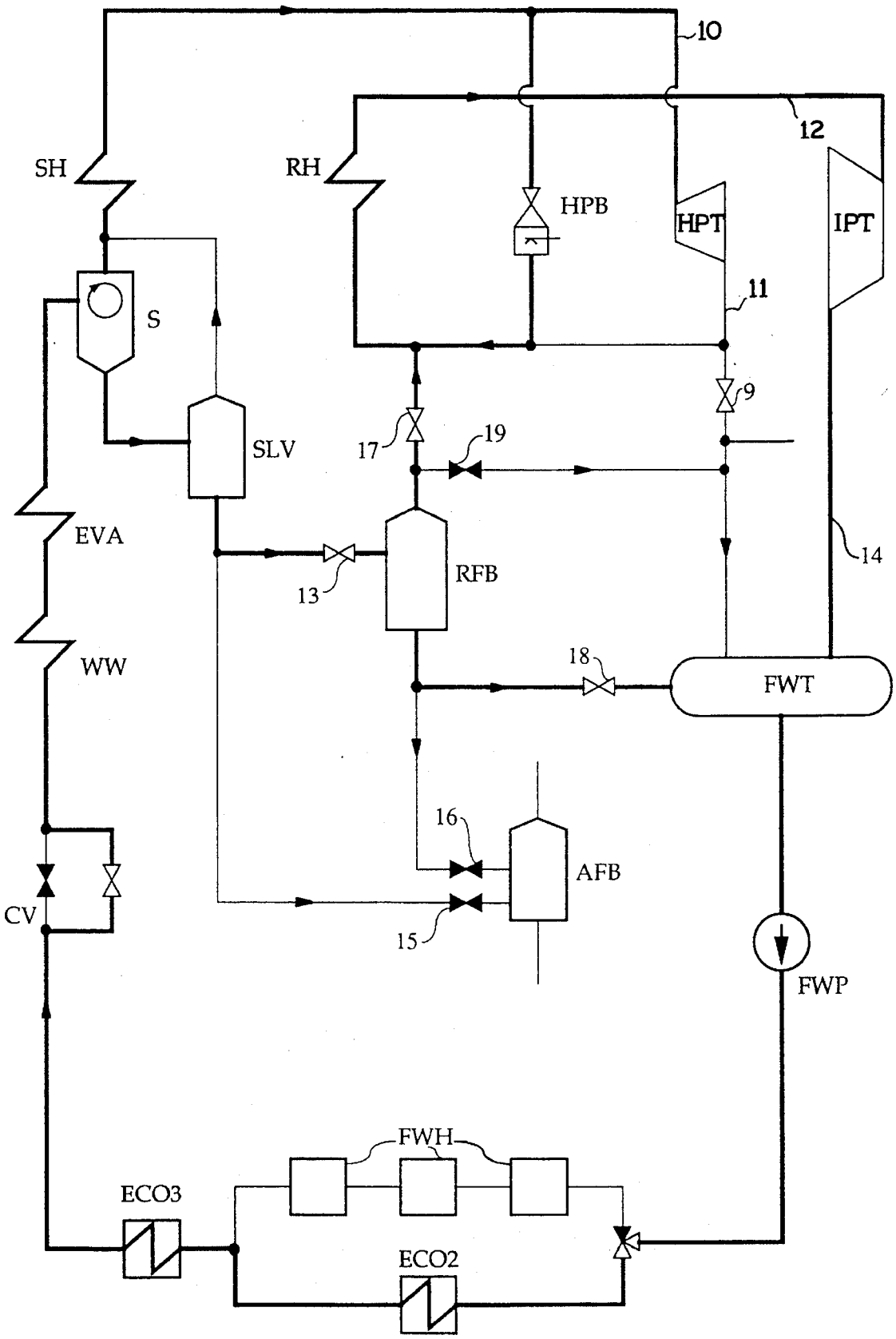
FIGS. 2–4 show the same embodiment of the steam system as FIG. 1 but including the flow paths of the steam/water during different phases of starting or partial-load operation in a PFBC power plant.

If the quality of the condensate in the moisture separator S with its associated level vessel SLV is acceptable, the condensate is passed to the reheater flashbox RFB and from there to the feedwater tank FWT via the valve 18. In this position, the valves 15 and 16 are closed. Since the pressure in the reheater flashbox RFB is considerably lower than in the level vessel SLV, from where the condensate emanates, a two-phase flow of water mixed with steam flashes into the reheater flashbox RFB. Steam is generated due to pressure reduction. The steam which arises is separated in the reheater flashbox RFB and is passed out via the valve 17 to the reheater RH for pressurization thereof. Consequently, the intention is to supply the reheater RH with steam even at this early stage of the starting process. A valve 19, which when the starting phase is completed conducts the steam from the reheater flashbox RFB to the feedwater tank FWT, is now closed. Pressure control of the high-pressure section and the intermediate-pressure section of the steam system is accomplished by means of the bypass valves HPB, LPB (not shown) of the turbines. The cycle during the heating phase of the combustor is illustrated in FIG. 2.

When the combustor heating phase is completed, heating combustors are ignited for preheating the bed such that the temperature of the gas supplied to the bed rises to a certain temperature, whereupon the temperature is maintained constant. During this bed heating phase, the steam production is increased and the live steam pressure can be increased to a value corresponding to the steam pressure which is required to attain single-phase flow to the evaporator EVA, which means subcooled feedwater, at the inlet to the tube bundle of the evaporator EVA. The mass flow distribution between the tubes of the evaporator EVA is now stable and the heating by means of the heating combustors can be increased again. The flow paths for water and steam are the same as during the combustor heating. Pressure increase also takes place in the same way. When flow stability (single-phase flow up to the evaporator EVA) has been achieved, the pressure increase rate can largely be chosen freely. A slower pressure increase on the high-pressure side increases the production of live steam at the expense of the steam production to the reheater. This results in a possibility of controlling the distribution of the steam flows to the two heating surfaces if, for example, the heat absorption of these surfaces is different. The maximum pressure increase rate is, however, limited by the permissible temperature transients that the boiler can withstand. The bed heating phase is completed when coal firing is established and full bed temperature is reached.

Figure 3:
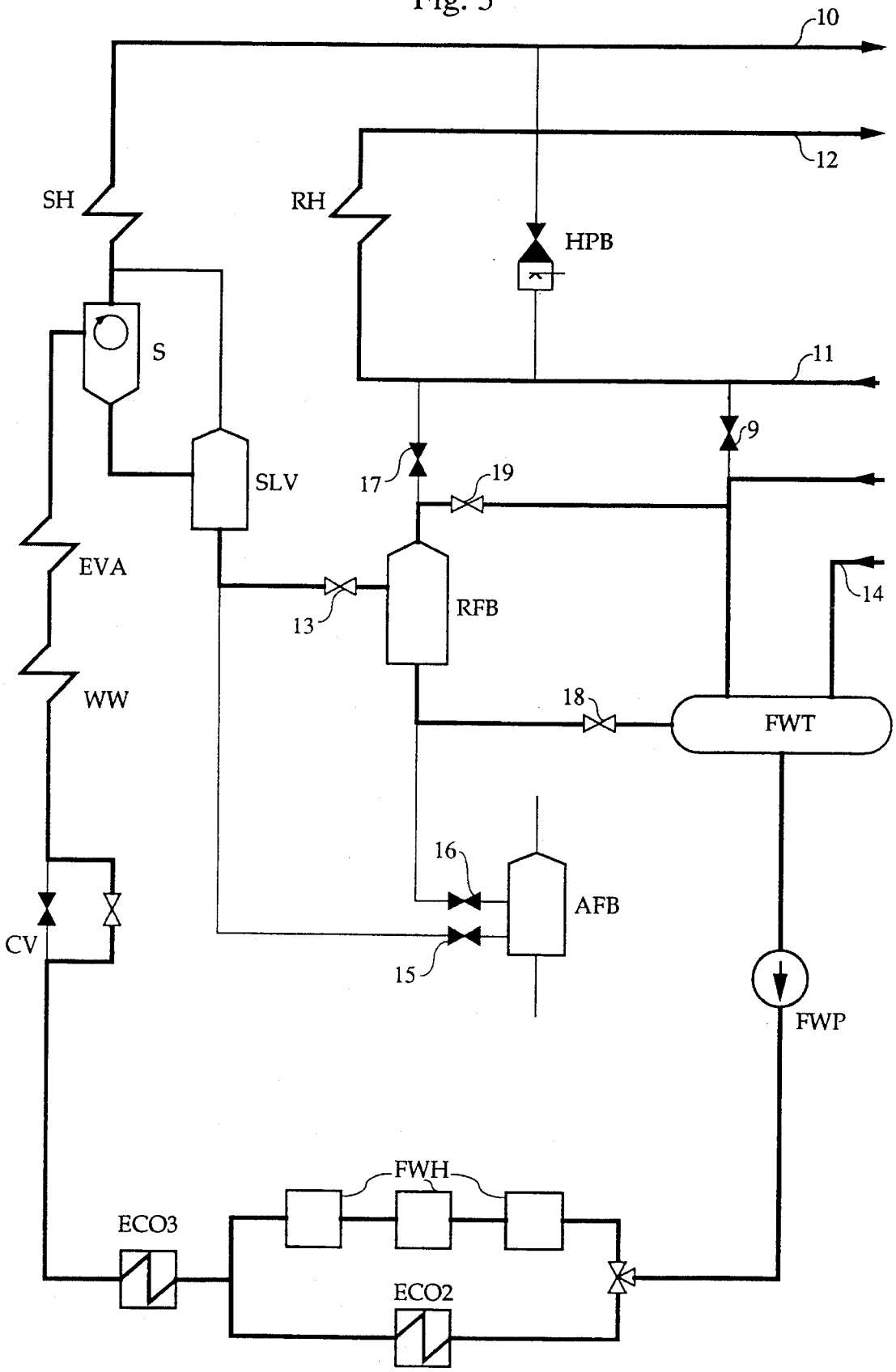

A change is now made to operation of the boiler below the Benson point. See FIG. 3. The steam turbine is assumed to be in operation. All steam pressures including the pressure in the feedwater tank FWT correspond to those which are normal for the load. The steam temperatures, on the other hand, are somewhat lower than what is the case during full-load operation. The feedwater minimum flow is now passed in parallel across the economizer ECO2 and the high-pressure preheaters FWH for feedwater and further via the economizer ECO3, the combustor walls WW, the evaporator EVA to the moisture separator S. The condensate which is separated at the moisture separator S is passed via the reheater flashbox RFB to the feedwater tank FWT. The reheater flashbox RFB for supplying steam to the reheater RH is now connected to the feedwater tank FWT on the steam side of the reheater flashbox RFB, which is the normal connection during operation after the starting phase in the plant.

Figure 4:
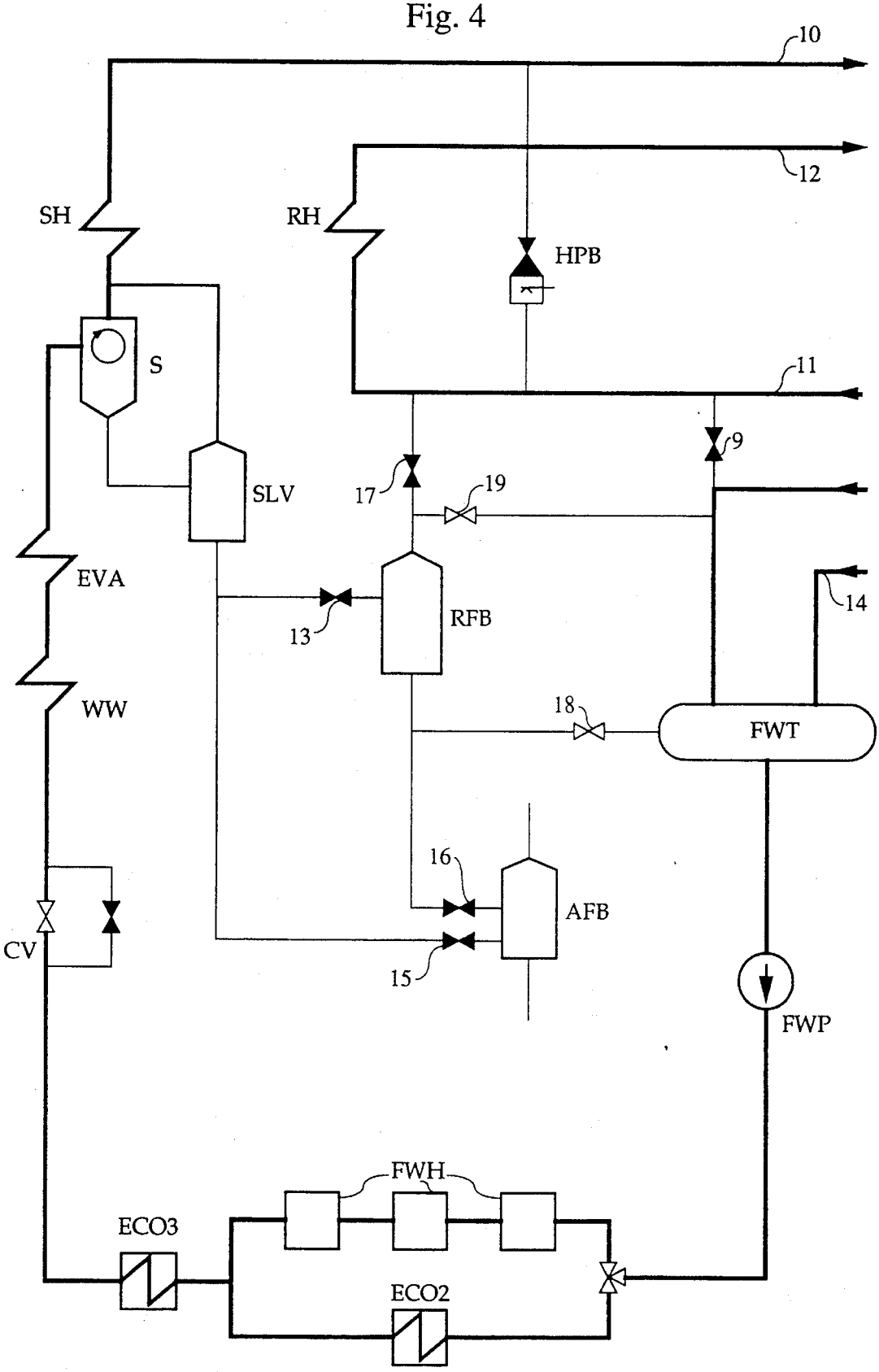

When changing to operation of the boiler above the Benson point according to FIG. 4, the boiler operates in pure once-through mode with a dry moisture separator S. All steam pressures correspond to those which are normal at full load. The steam temperatures are the same as at full load.

Figure 5:
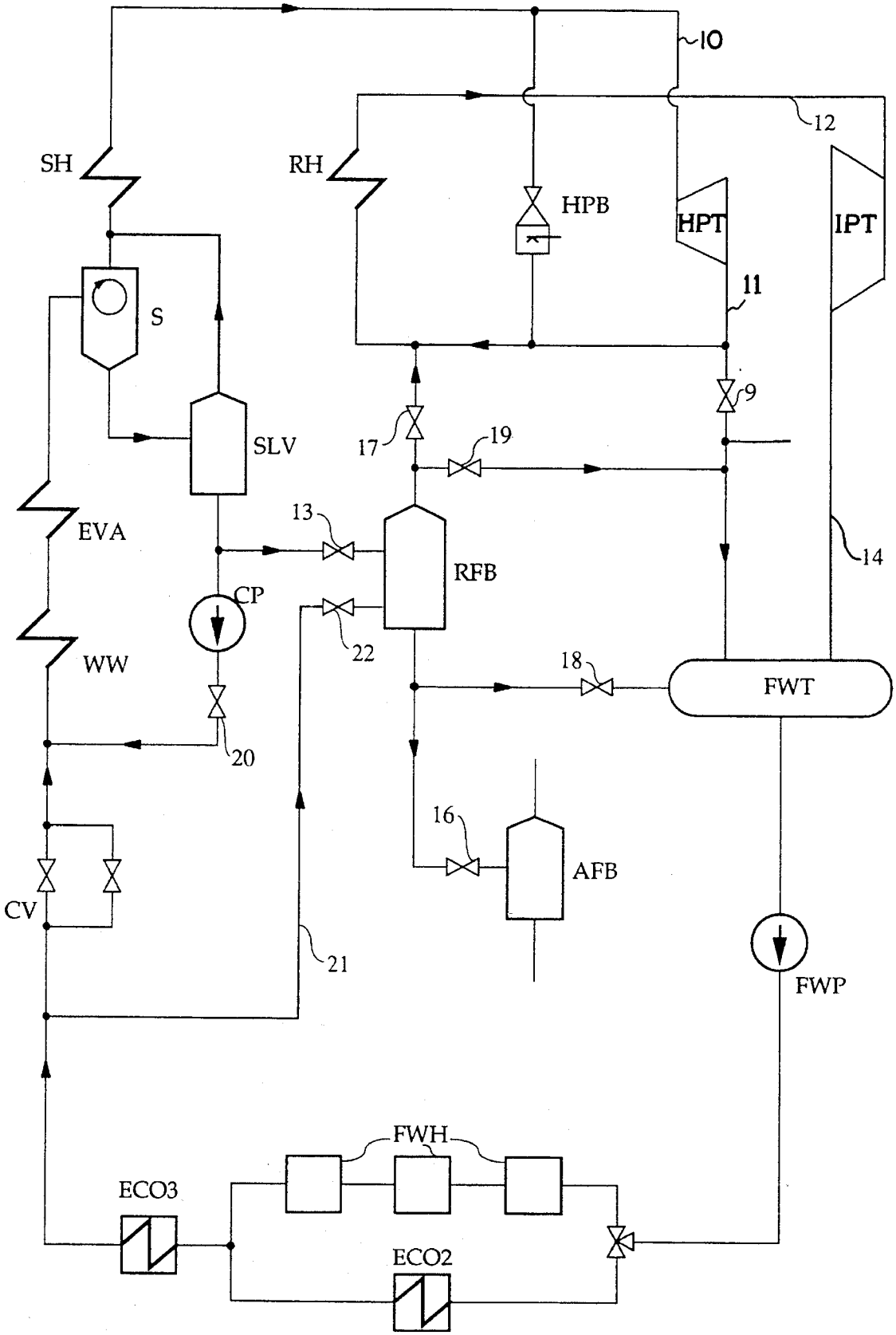
FIG. 5 illustrates a variant of the steam system according to the invention with a circulation pump for reintroduction of heated feedwater to the combustor.

In a variant of the steam system to the embodiment described, the connecting conduit for extraction of condensate from the level vessel SLV to the atmospheric flashbox AFB has been removed. In exchange therefor, a circulation pump CP with a valve 20 is connected in a conduit from the level vessel SLV to the feedwater circuit upstream of the combustor walls WW. See FIG. 5. In addition, an extraction conduit 21 is provided between the feedwater circuit upstream of the feedwater control valves CV to the reheater flashbox RFB.

The intention of the extraction conduit 21 is to ensure the cooling of the economizers ECO2 and ECO3 when the circulation pump CP is in operation. The extraction flow from the feedwater circuit prior to the feedwater control valves CV is controlled by the valve 22.

In the event that the circulation pump CP is not available, the plant can be started and driven in exactly the same way as in the embodiment described above without a circulation pump CP.

Figure 6:
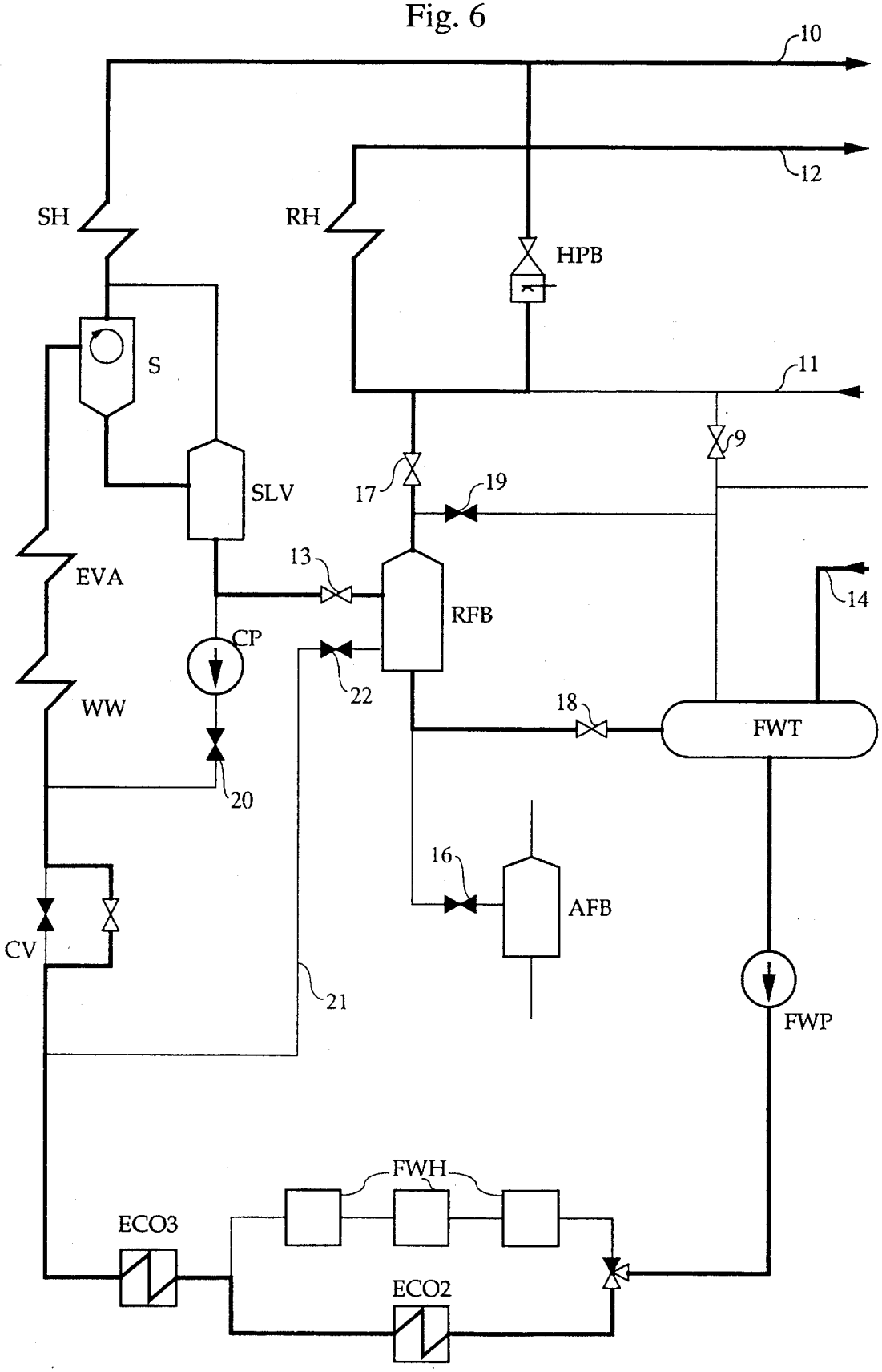
FIGS. 6–9 show the same embodiment of the steam system as FIG. 5 but including the flow paths of the steam/water during different phases of starting or partial-load operation in a PFBC power plant.

During the combustor heating phase while using the circulation pump CP, the steam and water flows are controlled as shown in FIG. 6. The circulation pump CP is not in operation. The function of the steam system is the same as in the steam system without the circulation pump CP. It is clear from the figure that steam is supplied to the reheater RH from the reheater flashbox RFB during this early stage of the starting phase.

Figure 7:
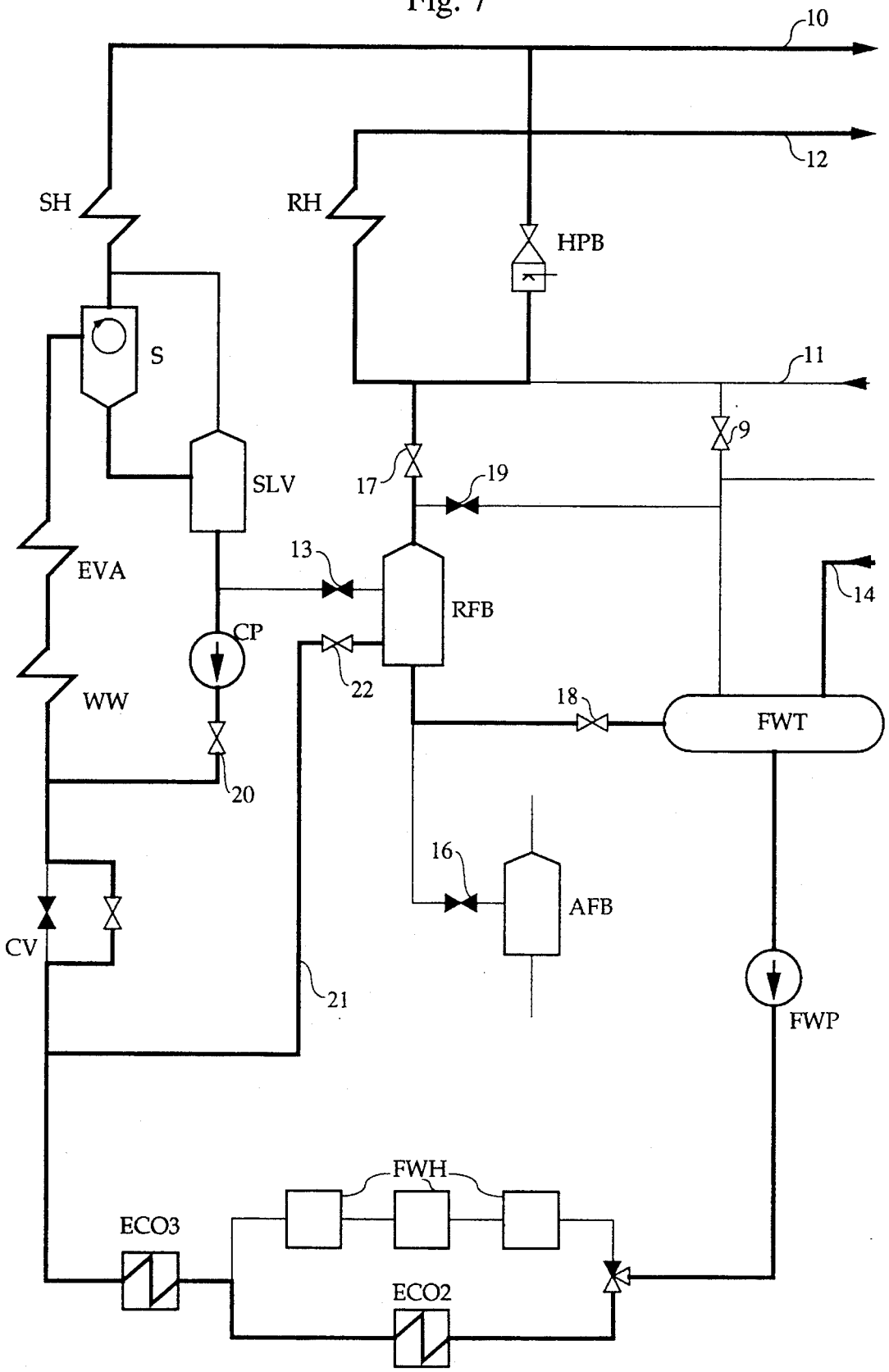

With reference to FIG. 7, the function during the bed heating phase upon start-up of the plant is described. In connection with the firing of the heating combustors, the circulation pump CP is started and the extraction conduit 21 is put into operation by opening the valve 22. The feedwater control valves CV control the feedwater flow to the boiler, whereas the valve 22 controls the flow through the economizers ECO2, ECO3. Contrary to the method of the embodiment described first, it is now possible to choose different minimum flows through the boiler and the economizers.

In the same way as in the method without a circulation pump CP, the pressure is first increased in the boiler, so that a single-phase flow is created at the inlet to the tube bundle of the evaporator EVA, which entails subcooled feedwater at this inlet. Also here this is achieved by increasing the temperature after the heating combustors to a certain value, whereupon the temperature is maintained constant. This state is maintained until the necessary boiler pressure has been attained. Because of pumping of condensate from the level vessel SLV by means of the circulation pump CP, the limit value for the necessary boiler pressure is somewhat higher than for the system without the circulation pump CP. When this limit value has been reached, the heating effort by means of the heating combustors is again increased.

The steam which has been separated in the reheater flashbox RFB during extraction from the feedwater flow upstream of the feedwater control valves CV is used for heating and pressurization of the reheater RH, which is thus supplied with steam at an early stage of the start-up of the plant.

Figure 8:
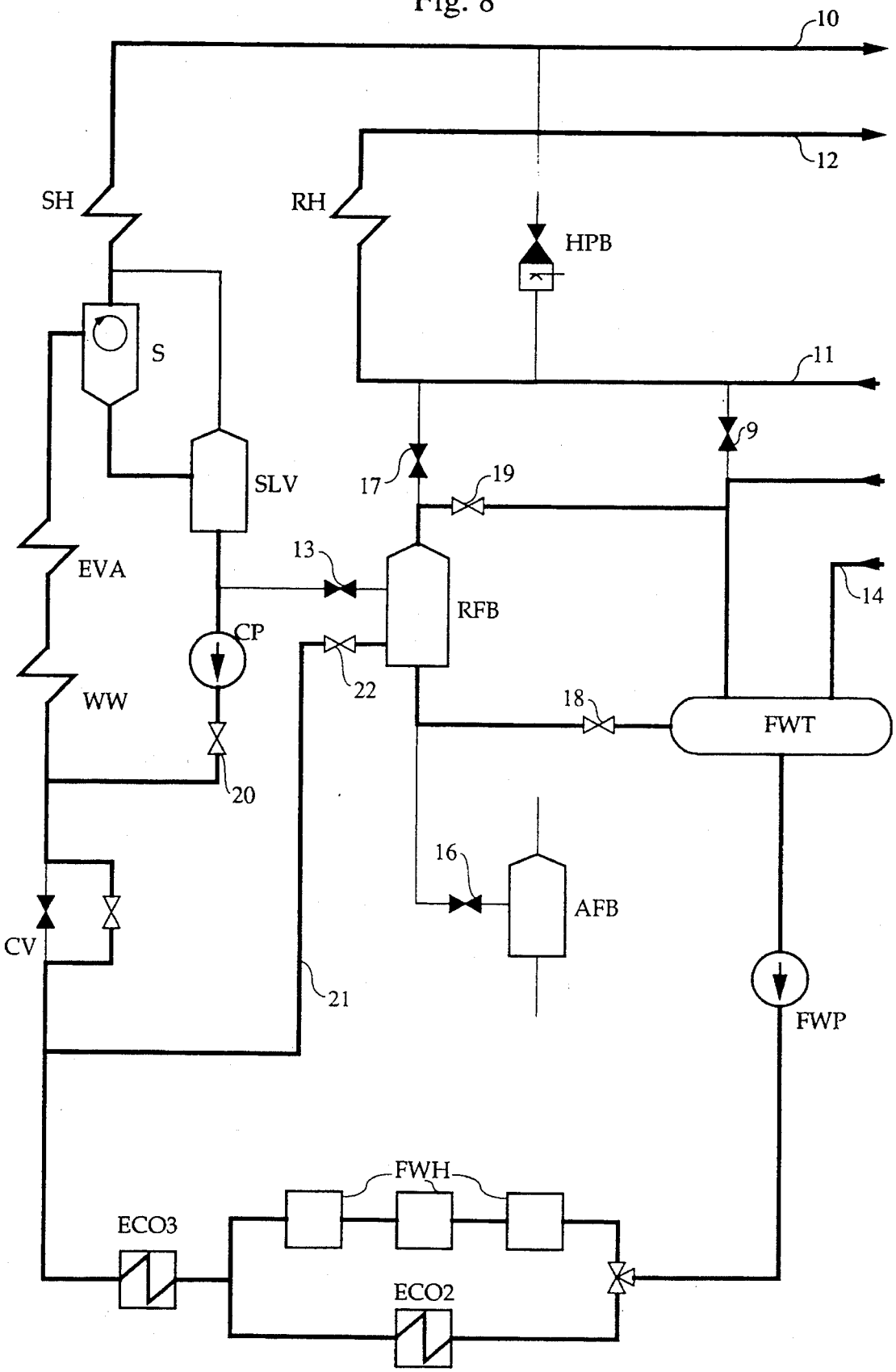

With the exception of the circulation pump CP being in operation and an extraction flow being established through the valve 22 to the reheater flashbox RFB, the function of the system during continued operation after the bed heating phase, but still below the Benson point, is the same as during a corresponding operation of the system according to the invention without the circulation pump CP, which is clear from FIG. 8.

Figure 9:
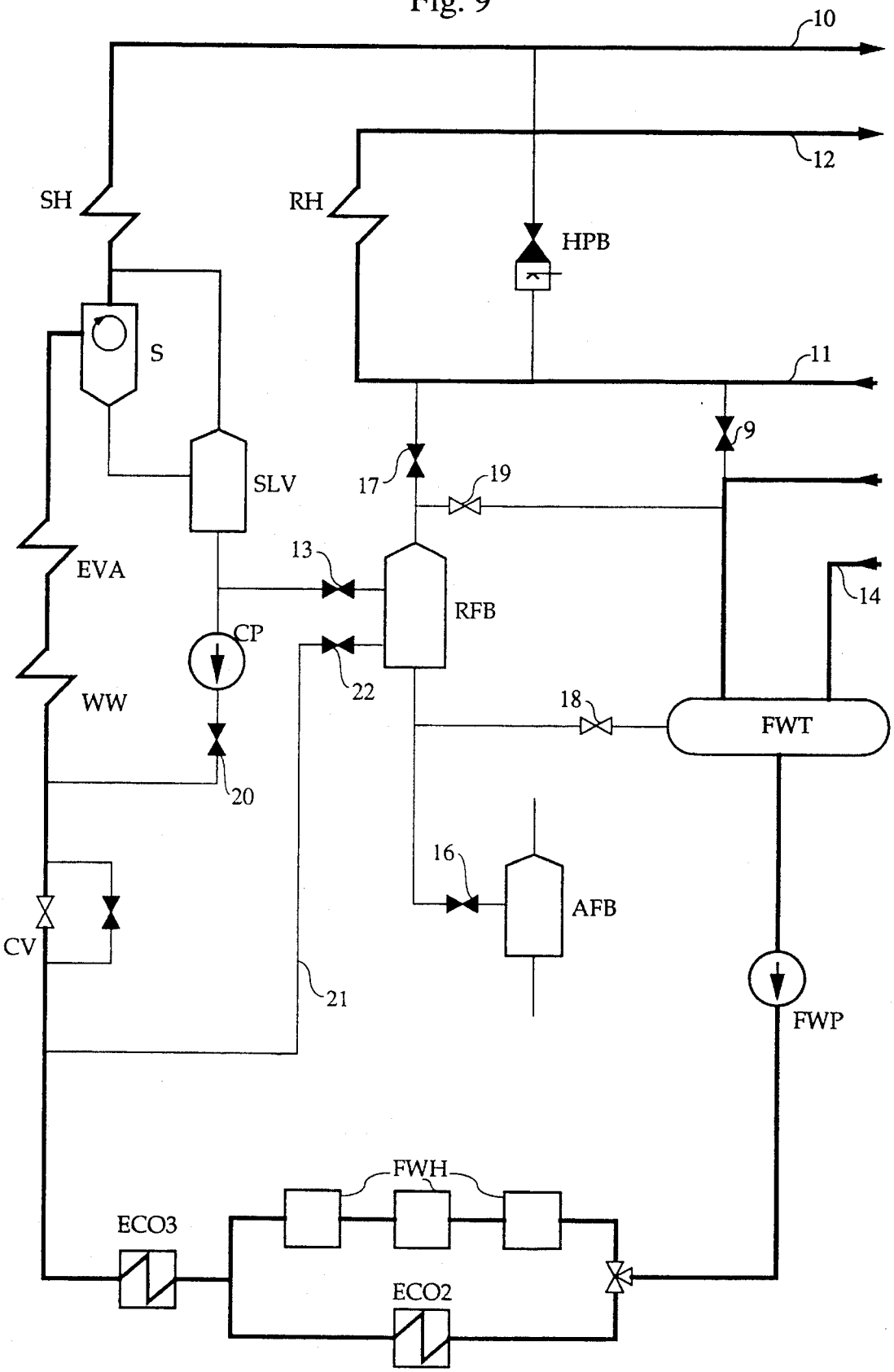

During normal operation of the plant according to FIG. 9 above the Benson point, the operating conditions are equivalent to those with the system without the circulation pump CP.

I claim:

1. A method for use during starting and/or low-load operation of a once-through boiler, comprising the steps of:

generating steam in a steam generator;

separating water from said steam in a moisture separator;

heating said steam in a superheater and feeding the steam to a high-pressure turbine;

returning expanded steam from the high-pressure turbine to a reheater for heating before supplying the steam to an intermediate-pressure turbine;

supplying the separated water from the moisture separator to a reheater flashbox; and feeding steam separated in the reheater flashbox to the reheater.

2. A method according to claim 1, further comprising the step of:

providing combustor walls upstream of the steam generator; and recirculating the separated water from the moisture separator upstream of the combustor walls.

3. A method according to claim 2, further comprising the step of:

controlling the flow of feedwater through the combustor walls and the steam generator with feedwater control valves; and extracting feedwater upstream of the feedwater control valves and passing the extracted feedwater to the reheater flashbox via an extraction conduit.

4. A method according to claim 3, further comprising the step of:

providing at least one economizer upstream of the feedwater control valves;

controlling the feedwater flow through the combustor walls and the steam generator by the feedwater control valves; and controlling the feedwater flow through the economizers with an extraction valve.

5. A method according to claim 1, further comprising the step of:

feeding drainage from the moisture separator to the reheater flashbox or to an atmospheric flashbox in dependence on the usefulness of the drainage, whereby drainage of a higher quality is passed to the reheater flashbox, whereas drainage of a lower quality is passed to the atmospheric flashbox.

6. A method according to claim 1, further comprising the step of:

providing a feedwater tank for storage of feedwater; and returning separated water from the reheater flashbox to the feedwater tank.

7. A method according to claim 1, further comprising the step of:

providing a feedwater tank for storage of feedwater; and passing steam from the reheater flashbox to the reheater or to the feedwater tank depending upon load conditions.

8. A method according to claim 7, wherein steam from the reheater flashbox is passed to the reheater during start-up of the boiler, whereas the steam is passed to the feedwater tank during low-load operation, when the reheater is cooled by means of steam from the high-pressure bypass valve.

9. A system used during starting and/or low-load operation of a once-through boiler for maximizing steam production in the superheater and reheater, said system comprising:

a steam generator for generating steam;

a moisture separator for receiving steam from said steam generator and separating water from the steam, the moisture separator having a first outlet and a drainage outlet;

a superheater connected to said first outlet for receiving the steam from the moisture separator and heating it;

a high-pressure turbine for receiving and expanding steam from the superheater;

a reheater including an inlet for receiving and heating the expanded steam from the high-pressure turbine, the reheater also including an outlet;

a reheater flashbox arranged downstream of and connected to the drainage outlet of the moisture separator for receiving said separated water, the reheater flashbox including a steam outlet which is connected to the inlet of the reheater for supplying steam separated in the reheater flashbox to the reheater during at least one of starting and low-load operation of the boiler; and an intermediate-pressure turbine for receiving steam heated in the reheater.

10. A system according to claim 9, wherein the steam generator is connected in series with the moisture separator, the superheater, the high-pressure turbine, the reheater, and the intermediate-pressure turbine.

11. A system according to claim 9, further comprising:

a feedwater tank for receiving condensed steam; and an atmospheric flashbox for receiving drainage from the reheater flashbox; and wherein the reheater flashbox further includes a drainage conduit interconnected with the feedwater tank and with the atmospheric flashbox, the drainage conduit supplying drainage from the reheater flashbox to the feedwater tank or to the atmospheric flashbox depending upon the quality of the drainage.

12. A system according to claim 9, further comprising:

combustor walls arranged upstream of the steam generator; and a circulation pump for pumping the separated water from the moisture separator to a point upstream of the combustor walls or to the reheater flashbox.

13. A system according to claim 9, further comprising:

feedwater control valves for controlling flow through the combustor walls;

an extraction conduit for extraction of feedwater, the extraction conduit being arranged between a location upstream of the feedwater control valves and the reheater flashbox; and an extraction conduit valve for controlling the flow through the extraction conduit.

14. A system according to claim 9, further comprising:

a feedwater tank for receiving condensed steam, wherein steam extracted from the reheater flashbox is supplied to the reheater via a first reheater flashbox valve or to the feedwater tank via second reheater flashbox valve.

* * * * *